US008455163B2

(12) United States Patent
Aoki et al.

(10) Patent No.: US 8,455,163 B2
(45) Date of Patent: Jun. 4, 2013

(54) ELECTROPHOTOGRAPHIC PHOTOSENSITIVE MEMBER AND ELECTROPHOTOGRAPHIC APPARATUS

(75) Inventors: Makoto Aoki, Yokohama (JP); Hironori Owaki, Susono (JP); Kazunari Ooyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 12/951,300

(22) Filed: Nov. 22, 2010

(65) Prior Publication Data

US 2011/0129770 A1 Jun. 2, 2011

(30) Foreign Application Priority Data

Nov. 27, 2009 (JP) ..... 2009-270833
Nov. 16, 2010 (JP) ..... 2010-256021

(51) Int. Cl.
*G03G 5/147* (2006.01)

(52) U.S. Cl.
USPC ..... 430/66; 430/57.4

(58) Field of Classification Search
USPC ..... 430/69, 66, 67, 57.4
See application file for complete search history.

(56) References Cited

U.S. PATENT DOCUMENTS

| | | | |
|---|---|---|---|
| 4,555,464 | A | 11/1985 | Kido et al. |
| 4,559,289 | A | 12/1985 | Sunagawa et al. |
| 4,569,855 | A | 2/1986 | Matsuda et al. |
| 4,659,639 | A | 4/1987 | Mizuno et al. |
| 4,683,144 | A | 7/1987 | Nishimura et al. |
| 4,683,145 | A | 7/1987 | Nishimura et al. |
| 4,683,146 | A | 7/1987 | Hirai et al. |
| 4,683,147 | A | 7/1987 | Eguchi et al. |
| 4,777,103 | A | 10/1988 | No et al. |
| 4,795,691 | A | 1/1989 | Takei et al. |
| 5,112,709 | A | 5/1992 | Yamazaki et al. |
| 5,164,281 | A | 11/1992 | Hayakawa et al. |
| 5,392,098 | A | 2/1995 | Ehara et al. |
| 5,455,138 | A | 10/1995 | Okamura et al. |
| 5,480,750 | A | 1/1996 | Kawada et al. |
| 5,582,944 | A | 12/1996 | Yamamura et al. |
| 5,817,181 | A | 10/1998 | Okamura et al. |
| 5,849,446 | A | 12/1998 | Hashizume et al. |
| 5,976,745 | A | 11/1999 | Aoki et al. |
| 6,110,629 | A | 8/2000 | Ehara et al. |
| 6,122,467 | A | 9/2000 | Ehara et al. |
| 6,183,930 | B1 | 2/2001 | Ueda et al. |
| 6,233,417 | B1 | 5/2001 | Nakayama et al. |
| 6,238,832 | B1 | 5/2001 | Hashizume et al. |
| 6,322,943 | B1 | 11/2001 | Aoki et al. |
| 6,605,405 | B2 | 8/2003 | Owaki et al. |
| 7,033,717 | B2 | 4/2006 | Kojima et al. |
| 7,157,197 | B2 | 1/2007 | Aoki et al. |
| 7,255,969 | B2 | 8/2007 | Kojima et al. |
| 7,276,318 | B2 | 10/2007 | Fujii et al. |
| 7,498,110 | B2 | 3/2009 | Taniguchi et al. |
| 2010/0014888 | A1 | 1/2010 | Ikeda et al. |
| 2010/0021835 | A1 | 1/2010 | Akiyama et al. |
| 2010/0021836 | A1 | 1/2010 | Ozawa et al. |
| 2010/0021837 | A1 | 1/2010 | Ozawa et al. |
| 2010/0112470 | A1 | 5/2010 | Ohira et al. |

FOREIGN PATENT DOCUMENTS

| | | | |
|---|---|---|---|
| CN | 1621948 | A | 6/2005 |
| CN | 101185036 | A | 5/2008 |
| CN | 101634817 | A | 1/2010 |
| EP | 0 220 993 | A | 5/1987 |
| EP | 1 158 368 | A2 | 11/2001 |
| EP | 1 887 427 | A1 | 2/2008 |
| EP | 2 148 245 | A1 | 1/2010 |
| JP | 58-080656 | A | 5/1983 |
| JP | 04-093864 | A | 3/1992 |
| JP | 05-018471 | A | 1/1993 |
| JP | 6-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 09-297420 | A | 11/1997 |
| JP | 10-104911 | A | 4/1998 |
| JP | 11-102080 | A1 * | 4/1999 |
| JP | 11-161120 | A | 6/1999 |
| JP | 2000-003055 | A | 1/2000 |
| JP | 3124841 | A | 1/2001 |
| JP | 2001-330978 | A | 11/2001 |
| JP | 2002-123020 | A | 4/2002 |
| JP | 2002-148907 | A | 5/2002 |
| JP | 2002-229303 | A | 8/2002 |
| JP | 2002-296987 | A | 10/2002 |

(Continued)

OTHER PUBLICATIONS

Japanese Patent Office machine-assisted English-language translation of JP 11-102080 (pub. Apr. 1999).*
Chinese Office Action dated Mar. 22, 2012, in related Chinese Application No. 201010566128.6 (with English translation).
U.S. Appl. No. 12/505,692, filed Jul. 20, 2009, Tomohito Ozawa et al.
U.S. Appl. No. 12/949,053, filed Nov. 18, 2010, Tomohito Ozawa et al.
U.S. Appl. No. 12/943,977, filed Nov. 11, 2010, Tomohito Ozawa et al.
U.S. Appl. No. 12/949,015, filed Nov. 18, 2010, Yuu Nishimura et al.
U.S. Appl. No. 12/952,311, filed Nov. 23, 2010, Yuu Nishimura et al.
U.S. Appl. No. 13/056,734, filed Jan. 31, 2011, Kazuyoshi Akiyama et al.
European Search Report dated Mar. 14, 2011, in related corresponding European Patent Application No. 10192513.9.

*Primary Examiner* — Janis L Dote
(74) *Attorney, Agent, or Firm* — Fitzpatrick, Cella, Harper & Scinto

(57) ABSTRACT

The present invention provides an electrophotographic photosensitive member including a conductive substrate, a photoconductive layer on the conductive substrate, and a surface layer made of hydrogenated amorphous silicon carbide on the photoconductive layer. A ratio (C/(Si+C)) in the surface layer is 0.61 to 0.75, both inclusive, an Si+C atom density in the surface layer is $6.60\times10^{22}$ atoms/cm$^3$ or more, and an arithmetic average roughness Ra of the surface layer is 0.029 μm to 0.500 μm, both inclusive.

11 Claims, 5 Drawing Sheets

FOREIGN PATENT DOCUMENTS

| | | | |
|---|---|---|---|
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

* cited by examiner

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member including a surface layer made of hydrogenated amorphous silicon carbide (hereinafter also referred to as "a-SiC"), and an electrophotographic apparatus including the electrophotographic photosensitive member. The surface layer made of hydrogenated amorphous silicon carbide is hereinafter also referred to as "a-SiC surface layer".

2. Description of the Related Art

In an electrophotographic apparatus, a surface of an electrophotographic photosensitive member on which a photoconductive layer (photosensitive layer) is provided is charged, and then an image exposure light is applied to form an electrostatic latent image on the surface of the electrophotographic photosensitive member. Further, toner is applied to the electrostatic latent image on the surface of the electrophotographic photosensitive member to form a toner image, and the toner image is transferred to a transfer material such as paper to form an image. After the electrophotographic apparatus thus forms the image, a part of the toner remains on the surface of the electrophotographic photosensitive member. Thus, the residual toner needs to be removed. Generally, residual toner is removed in a cleaning process using a cleaning blade, a fur brush, or a magnet brush, and is typically removed in a cleaning process using a cleaning blade.

However, in recent years, toner having a smaller average particle size than conventional has been used for higher image quality, and it has become difficult to remove residual toner in the cleaning process. Specifically, to clean the residual toner having a small particle size, for example, pressing pressure of a cleaning blade needs to be increased. This may cause a burr of the cleaning blade or an increase in running torque of an electrophotographic photosensitive member. To solve the above-described problems, Japanese Patent Application Laid-Open No. H9-297420 proposes a method in which in an electrophotographic photosensitive member having a photosensitive layer of amorphous silicon, a surface of a conductive substrate that forms the photosensitive layer is previously made rough by a cutting or a rotation ball mill apparatus. Japanese Patent Application Laid-Open No. 2001-330978 proposes a method of controlling microscopic surface roughness Ra in a range of 10 μm×10 μm of an electrophotographic photosensitive member to a predetermined value to effectively prevent toner application.

As described above, effective cleaning of residual toner has been conventionally improved. However, the market's demands for image quality have been further increased. In particular, there is a significant demand for image quality in the market of print-on-demand (hereinafter also referred to as "POD") such as near-print or a pictorial field. For example, minute fluctuations in concentration (a banding phenomenon) due to irregular rotation of the electrophotographic photosensitive member or a minute cleaning failure, which have not been heretofore problems, cannot be accepted.

To effectively clean residual toner, adjustment items such as the material, hardness, or pressing pressure of a cleaning blade, the shape or material of a surface of an electrophotographic photosensitive member, the material or particle size of toner, the material or amount of an external additive need to be appropriately adjusted. However, when toner having a small particle size is used, such a setting range may be reduced, and sufficient design latitude cannot be obtained, which may prevent design. Also, repeating image forming may gradually change activity of the surface of the electrophotographic photosensitive member depending on set values of the adjustment items, which may increase running torque of the electrophotographic photosensitive member. This phenomenon is expected as described below. A discharge product formed in or near a charger changes activity such as surface free energy of the surface of the electrophotographic photosensitive member. Thus, it is supposed that substances existing near the electrophotographic photosensitive member such as toner, a toner external additive, paper dust, or binder resin of an intermediate transfer body in some cases are easily applied to the surface, then a friction force between the surface of the electrophotographic photosensitive member and a cleaning blade changes. The increase in running torque may prevent smooth rotation of the electrophotographic photosensitive member, and cause a banding phenomenon. In particular, when the substrate processing as described in Japanese Patent Application Laid-Open No. H9-297420 is not performed, the banding phenomenon tends to easily occur.

Even when the substrate processing is performed, the substrate processing is effective in an initial stage, but a long-term use may increase running torque of the electrophotographic photosensitive member and cause a banding phenomenon or a cleaning failure. In Japanese Patent Application Laid-Open No. 2001-330978, only microscopic roughness of a substrate is considered, and using toner having a small particle size or a long-term use may increase running torque of an electrophotographic photosensitive member or cause a banding phenomenon.

SUMMARY OF THE INVENTION

The present invention has an object to provide an electrophotographic photosensitive member that can output a high quality image for a long time period, and an electrophotographic apparatus including the electrophotographic photosensitive member.

The present invention provides an electrophotographic photosensitive member including a conductive substrate, a photoconductive layer on the conductive substrate, and a surface layer made of hydrogenated amorphous silicon carbide on the photoconductive layer, wherein the ratio (C/(Si+C)) of the number of carbon atoms (C) to the sum of the number of silicon atoms (Si) and the number of carbon atoms (C) in the surface layer is 0.61 to 0.75 (both inclusive), the sum of the density of silicon atoms and the density of carbon atoms in the surface layer is $6.60\times10^{22}$ atoms/cm$^3$ or more, and arithmetic average roughness Ra of the surface layer defined by JIS B0601:2001 is 0.029 μm to 0.500 μm (both inclusive). The present invention also provides an electrophotographic apparatus including the electrophotographic photosensitive member.

According to the present invention, design latitude for cleaning can be increased, and a banding phenomenon caused by an increase in running torque of the electrophotographic photosensitive member can be prevented, thereby allowing a high quality image to be maintained for a long time period.

Further features of the present invention will become apparent from the following description of exemplary embodiments with reference to the attached drawings.

DESCRIPTION OF THE EMBODIMENTS

Figure 1:
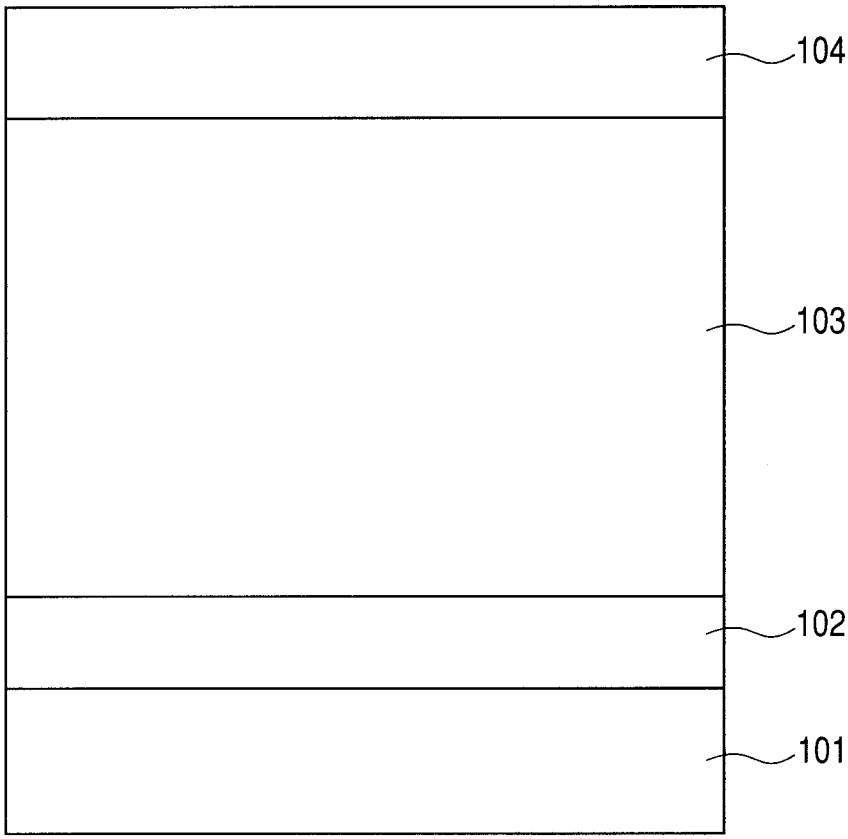
FIG. 1 illustrates an example of a layer configuration of an electrophotographic photosensitive member of the present invention.

Preferred embodiments of the present invention will now be described in detail in accordance with the accompanying drawings.

An electrophotographic photosensitive member of the present invention includes a conductive substrate, a photoconductive layer on the conductive substrate, and a surface layer (a-SiC surface layer) made of hydrogenated amorphous silicon carbide on the photoconductive layer. The inventors have diligently studied and found that a-SiC surface layer with a low initial friction coefficient and a small increase in friction coefficient by use can be formed by appropriately controlling a physical property that is variable by composition of the a-SiC surface layer. The increase in friction coefficient is expected to occur because an electrophotographic photosensitive member is exposed to a discharge product in a charging process, surface free energy of the electrophotographic photosensitive member changes, and various substances such as a component of toner are applied to the surface. Thus, it is supposed that appropriately controlling a physical property that is variable by composition of the a-SiC surface layer can prevent changes in activity of the surface of the electrophotographic photosensitive member even if the surface is exposed to the discharge product.

In addition, it has been found that the shape of the surface (surface of the a-SiC surface layer) of the electrophotographic photosensitive member is improved to appropriately control an abutment area between the cleaning blade and the surface of the electrophotographic photosensitive member, and thus satisfactory cleaning is continuously achieved from an initial stage over a long-term use, and an increase in running torque of the electrophotographic photosensitive member can be prevented. The control of the physical property such as the composition of the surface layer is also referred to as "physical property control", and the control of the shape of the surface of the electrophotographic photosensitive member is also referred to as "surface roughness control". The combination of the physical property control and the surface roughness control has been further optimized to reach the present invention. Now, the physical property control and the surface roughness control will be described in detail.

(Physical Property Control)

Generally, a carbon-based material has high lubricity and is often used as a material for the surface layer of the electrophotographic photosensitive member. However, the carbon-based material significantly absorbs a red light or an infrared light often used as an image exposure light, which may reduce sensitivity of the electrophotographic photosensitive member. Meanwhile, when silicon carbide is used, higher light transmittance is obtained than when the carbon-based material that does not contain silicon atoms is used. However, an increase in the silicon atom content may reduce resistance to cause a drift of charges on the surface of the electrophotographic photosensitive member. Such a drift of charges may reduce resolution or gradation property. Meanwhile, an increase in the carbon atom content increases absorption of the image exposure light. It has been found that if the ratio (C/(Si+C)) of the number of carbon atoms (C) to the sum of the number of silicon atoms (Si) and the number of carbon atoms (C) (hereinafter simply referred to as "C/(Si+C)") is 0.61 to 0.75 (both inclusive), a range with a good balance between high lubricity of the carbon-based material, transmittance of the image exposure light, and resistance of the surface layer is provided.

However, it has been found that simply optimizing composition of the carbon atoms and the silicon atoms cannot maintain initial lubricity of the electrophotographic photosensitive member, and may cause a cleaning failure or a banding phenomenon. The inventors expect the reasons as described below. Specifically, for a long-term image forming, the surface of the electrophotographic photosensitive member is exposed to a discharge product such as ozone, toner, a toner external additive, or paper dust. In particular, when a primary charger or a transfer charger using corona discharge is used, the surface of the electrophotographic photosensitive member is exposed to a large amount of discharge product, which may probably alter the surface of the electrophotographic photosensitive member. For an electrophotographic photosensitive member having a surface easily worn by rubbing, the surface of the electrophotographic photosensitive member is always refreshed, and an altered portion (altered layer) is hard to remain. However, for the electrophotographic photosensitive member having the a-SiC surface layer, the surface has very high hardness and is hard to wear by rubbing, and thus an altered layer is hard to remove. It is supposed that the altered layer does not have high lubricity as in the carbon-based material, and with growth of the altered layer, running torque of the electrophotographic photosensitive member is increased, then a cleaning failure or a banding phenomenon easily occurs.

Then, the inventors have further studied and found that the sum of the density of silicon atoms and the density of carbon atoms (hereinafter also referred to as "Si+C atom density") in the a-SiC surface layer is set to $6.60\times10^{22}$ atoms/cm$^3$ or more, more preferably $6.81\times10^{22}$ atoms/cm$^3$ or more, and thus long-term image forming does not easily alter the surface of the electrophotographic photosensitive member. The high Si+C atom density means a short atomic distance between the silicon atom and the carbon atom that forms a skeleton of a layer structure of the a-SiC surface layer. Thus, it is supposed that a bonding force between the atoms that form the skeleton of the layer structure of the a-SiC surface layer is increased to make the surface of the electrophotographic photosensitive member difficult to alter. Also, it is supposed that the high density reduces porosity to make it difficult for a discharge product (ionic species) to enter the a-SiC surface layer in its depth direction and react. There is no specific upper limit of the Si+C atom density, but it is supposed that a-SiC (hydrogenated amorphous silicon carbide) is an amorphous substance and thus does not have a density higher than that of crystal. Thus, the Si+C atom density obtained by the surface layer in the above-described composition range is theoretically $13.0\times10^{22}$ atoms/cm$^3$ or less.

The amount of hydrogen atoms contained in the a-SiC surface layer can be controlled to provide a better balance between resistance to attack by ion species and other properties such as sensitivity of the electrophotographic photosensitive member. Specifically, the ratio (H/(Si+C+H)) of the number of hydrogen atoms (H) to the sum of the number of silicon atoms (Si), the number of carbon atoms (C) and the number of hydrogen atoms (H) (hereinafter also simply referred to as "H/(Si+C+H)") can be 0.30 to 0.45 (both inclusive). In an a-SiC surface layer with high Si+C atom density, an optical band gap is easily reduced and light absorption increases, which may reduce sensitivity of the electrophotographic photosensitive member. However, with H/(Si+C+H) of 0.30 or more, the optical band gap is increased, then sensitivity of the electrophotographic photosensitive member improves.

Meanwhile, with H/(Si+C+H) larger than 0.45, terminal groups with many hydrogen atoms such as a methyl group tend to increase in the a-SiC surface layer. The terminal groups may form a large space in the a-SiC structure, cause a strain of bonding between atoms existing around there, or prevent networking of the Si—C structure. It is supposed that such weakness in structure forms a weak portion against attack by ion species. From the above, H/(Si+C+H) can be 0.30 to 0.45 (both inclusive).

(Surface Roughness Control)

As described above, the physical property control increases lubricity of the surface as compared to a conventional surface layer, and the advantage can be maintained for a long time period, but appropriate cleaning of toner having a small particle size needs to be further improved. For example, in cleaning using a cleaning blade (hereinafter also referred to as "blade cleaning"), hardness of the cleaning blade and pressing pressure of the cleaning blade (hereinafter also referred to as "blade pressure") need to be appropriately set. In particular, for satisfactory cleaning in an electrophotographic process using a small particle size toner, the blade pressure is often set to a high value, which may cause chatter (fine vibration) of the cleaning blade or curling (turnover) of the cleaning blade. Also, the cleaning blade applies a brake to rotation of the electrophotographic photosensitive member, and thus with high blade pressure, running torque of the electrophotographic photosensitive member is easily increased. Excessive running torque of the electrophotographic photosensitive member may cause irregular rotation, and cause a banding phenomenon in an output image. If a blade pressure range is to be set in which chatter or curling of the cleaning blade does not occur, a banding phenomenon due to torque changes does not occur, and a satisfactory image can be output, design latitude (adjustment allowance) may be reduced. Thus, blade pressure may be beyond an appropriate value by individual differences of a friction coefficient of the surface of the electrophotographic photosensitive member or the amplitude of blade pressure adjustment.

Then, it has been found that the surface roughness control is performed in addition to the physical property control of the surface layer of the electrophotographic photosensitive member to increase the cleaning latitude, and a satisfactory cleaning state can be always held from an initial stage in a long-term use. Meanwhile, if the roughness is increased too much, moire (streak pattern generated by misalignment of cycles when a plurality of regular repeated patterns is overlaid) may occur. The moire is waves between a space frequency of a surface shape and a space frequency of image forming (cycle of laser scanning), and too large a step increases the waves to cause a concentration difference, which may appear in an image. Thus, surface roughness should not be increased too much.

From the above points, specifically, under the above-described physical property condition, arithmetic average roughness Ra of the surface layer defined by JIS B0601:2001 is set to 0.029 μm to 0.500 μm (both inclusive). It has been found that at this time, a cleaning failure, chatter or curling of the cleaning blade, an increase in running torque of the electrophotographic photosensitive member hardly occur, and the property is maintained from an initial stage for a long time period. In this range, image defects such as moire hardly occur. More preferably, the arithmetic average roughness Ra can be 0.050 μm to 0.200 μm (both inclusive). The degree of contact with the cleaning blade is not determined by local maximum and minimum heights but by roughness in a long span. Thus, an average shape of the surface, that is, an average distance of roughness and an average depth of roughness can be controlled.

As a parameter corresponding to the average distance of roughness, an average length Rsm of a roughness curve element (average length of roughness in a reference length) defined by JIS B0601:2001 can be used. A range of Rsm can be 1.0 μm to 150.0 μm (both inclusive). As a parameter corresponding to the average depth of roughness, Rzjis (ten point average roughnesses) can be used according to JIS B 0601:2001. A range of Rzjis can be 0.100 μm to 2.000 μm (both inclusive). The difference between Ra and Rzjis will be described. Ra refers to average roughness in the surface, which is the most important in the present invention. Rzjis is more easily affected by relatively large roughness than Ra, but the relatively large roughness are also important in view of the degree of rubbing against the cleaning blade. In particular, for an irregular surface property, there may be a difference in Rzjis even with the same Ra. In this case, Rzjis can be used as an index of a more desirable range.

Comparing a case with a cycle structure such as processing with a lathe with a case without a cycle structure such as processing with a ball mill, there is no difference in advantage of the present invention with the same views of Ra, Rsm, and Rzjis. However, the case with a cycle structure is more desirable in view of easiness in production and stability of quality. As a processing method of a conductive substrate, a method called imprinting of pressing a mold can be used for forming a structure with a short cycle of 10 μm or less. For forming a structure with a long cycle of 10 μm or more, cutting with a lathe can be used. By these methods, cyclic roughness are formed in the surface of the conductive substrate, and then the photoconductive layer is formed on the conductive substrate. In forming a photoconductive layer and a surface layer by a CVD method, growth occurs with the shape of a base being substantially maintained. Thus, the roughness in the surface of the electrophotographic photosensitive member can be controlled by processing of the surface of the conductive substrate as the base.

The surface roughness control and the physical property control described above are combined to obtain the advantage of the present invention. When a surface layer having composition other than that of the present invention is used, the advantage of the present invention cannot be obtained even using the surface roughness control of the present invention. When a conventional material is used, a long-term use may cause the surface of the electrophotographic photosensitive member to be always attacked by active molecules such as ozone to alter the surface layer. A portion in contact with the cleaning blade gradually wears and is refreshed, and thus an altered layer hardly grows in the portion. Meanwhile, in a portion not in contact with the cleaning blade or a recessed portion with low contact pressure, an altered layer easily grows. When wettability (surface free energy) with the substance changes in this portion, a toner component such as toner or an external additive, a binder component such as a transfer belt, or a filler component such as paper dust is easily applied, thereby affecting a cleaning property or a friction coefficient of the surface of the electrophotographic photosensitive member. Thus, to maintain a satisfactory cleaning property or running torque of the electrophotographic photosensitive member for a long time period, the physical property control of the present invention is required so that even the recessed portion hardly in contact with the cleaning blade is not altered.

(Electrophotographic Photosensitive Member of the Present Invention)

FIG. 1 illustrates an example of a layer configuration of an electrophotographic photosensitive member of the present invention. FIG. 1 illustrates a conductive substrate 101, a lower injection preventing layer 102, a photoconductive layer 103, and a surface layer 104. The photoconductive layer 103 is made of hydrogenated amorphous silicon (hereinafter also referred to as "a-Si"). Hereinafter, the photoconductive layer made of a-Si is also referred to as "a-Si photoconductive layer", and an electrophotographic photosensitive member including the a-Si photoconductive layer is also referred to as "a-Si photosensitive member". The layers illustrated in FIG. 1 are formed by a vacuum deposition layer forming method, for example, a radiofrequency CVD method, by setting numerical conditions of layer forming parameters so as to obtain a desired property.

(Conductive Substrate)

The conductive substrate is made of, for example, copper, aluminum, nickel, cobalt, iron, chromium, molybdenum, titanium, or alloys thereof. Among these materials, aluminum is superior in view of a processing property or production costs. Among aluminum, Al—Mg alloy or Al—Mn alloy can be used.

To form appropriate roughness in the surface of the electrophotographic photosensitive member, roughness processing can be performed in the surface of the conductive substrate. One example is cutting with a lathe. The lathe includes a tool rest (turret) to which a cutting tool can be mounted, and can cut while rotating the conductive substrate. First, the conductive substrate is set on an unshown lathe. To process an outer surface of the conductive substrate, the conductive substrate needs to be held from inside. An example of a holding unit for holding the conductive substrate from inside is a collet chuck.

With the conductive substrate being held by the holding unit such as the collet chuck, the conductive substrate is set on the lathe, and an outer surface cutting process is performed. Specifically, the conductive substrate is rotated at, for example, 2000 rpm, the tool is moved in a generating line direction of the conductive substrate at a predetermined tool feed speed in a predetermined tool cutting amount to cut the outer surface. The tool feed speed and the rotational speed of the conductive substrate determine a pitch (cycle) of roughness by cutting. The shape and contact angle of the tool determine a depth of the roughness. The pitch and the depth are appropriately adjusted to determine a surface shape of the conductive substrate.

Figure 4A:
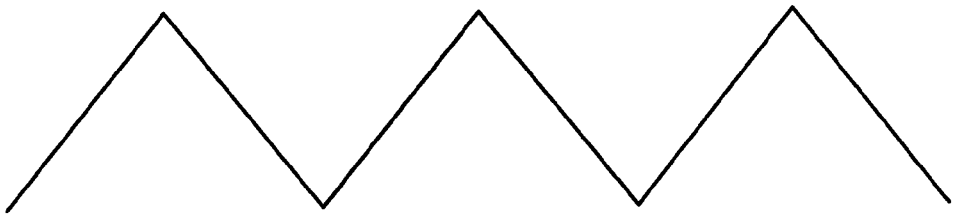
FIG. 4A illustrates a shape of the surface of the conductive substrate formed by tool cutting.
Figure 4B:
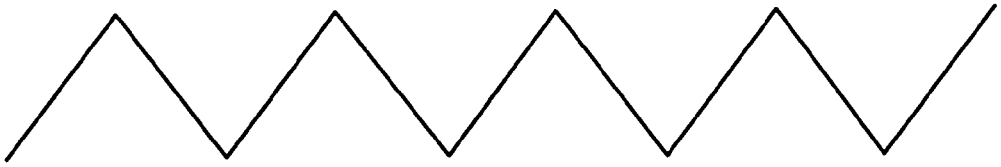
FIG. 4B illustrates a shape of the surface of the conductive substrate formed by tool cutting.
Figure 4C:
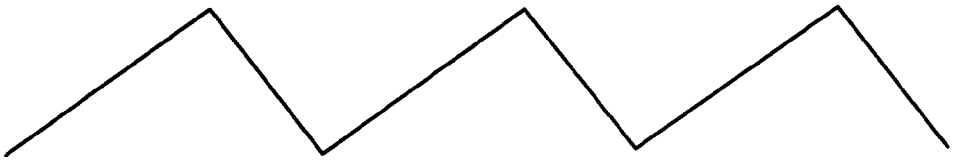
FIG. 4C illustrates a shape of the surface of the conductive substrate formed by tool cutting.
Figure 4D:
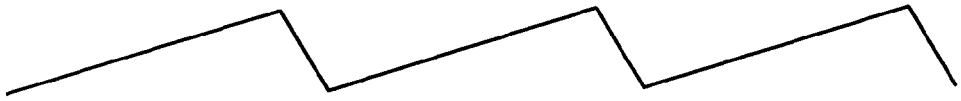
FIG. 4D illustrates a shape of the surface of the conductive substrate formed by tool cutting.

FIGS. 4A, 4B, 4C and 4D illustrate shapes of the surface of the conductive substrate formed by tool cutting. As illustrated in FIGS. 4A, 4B, 4C and 4D, even with the same tool application manner, changing the feed speed can change the pitch and depth as illustrated in FIGS. 4A and 4B. As illustrated in FIGS. 4C and 4D, changing the angle can change the depth and shape with the same pitch. A lathe processing condition is determined so that surface roughness Ra (JIS B0601:2001) after the photoconductive layer and the surface layer are formed on the conductive substrate is 0.029 μm or more to 0.500 μm. Ra can be set to be 0.050 μm to 0.200 μm (both inclusive). Further, the depth of the roughness of the surface after the photoconductive layer and the surface layer are formed can be 0.10 μm to 2.00 μm (both inclusive), and the pitch can be 1.0 μm to 150.0 μm (both inclusive). More preferably, the depth can be 0.50 μm to 1.50 μm (both inclusive), and the pitch can be 10.0 μm to 30.0 μm (both inclusive). Too small a depth prevents the running torque of the electrophotographic photosensitive member from being effectively reduced, and too large a depth easily causes moire in an output image. Too small a pitch makes it difficult for the cleaning blade to follow to the back of a recess portion depending on the depth of the roughness. To appropriately clean minute particles such as a toner external additive, a relatively large pitch can be used. Meanwhile, too large a pitch causes deformation of the cleaning blade to be easily followed, thereby increasing a friction force.

In processing with the lathe, the pitch can be 10.0 μm or more. For the pitch of 10.0 μm or less, a long processing time is required, the life of the tool is reduced, or accuracy is reduced in some cases. When the pitch of 10 μm or less is required, a method called imprinting of pressing a mold called a touch roll or a stamper to form roughness can be used. Aluminum or aluminum alloy is relatively softer than other metal, and can be easily processed if the depth is not very large. The sectional shape of the mold used for imprinting may be a rectangular structure, a sawtooth shape, or a waveform. The sectional shape may be a groove shape continuous in a circumferential direction, or a shape with dots being regularly arranged. In either case, when a section is taken on any plane passing through a central axis of a cylinder, there may be a portion having roughness. Such roughness perpendicular to a rotational direction can be formed to reduce a friction force with the cleaning blade and reduce the running torque of the electrophotographic photosensitive member.

Figure 3A:
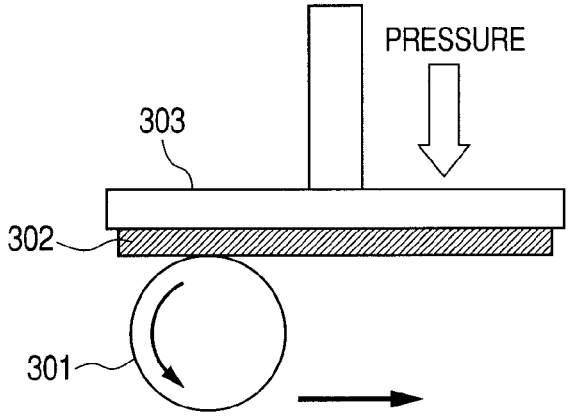
FIG. 3A illustrates a shape of a surface of a conductive substrate formed by imprinting.
Figure 3B:
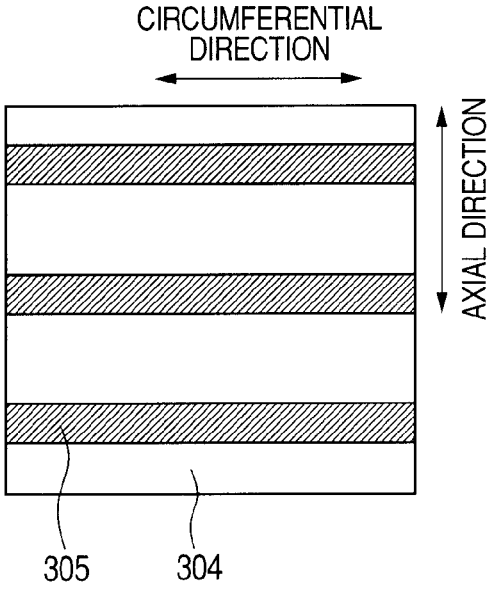
FIG. 3B illustrates a shape of the surface of the conductive substrate formed by imprinting.
Figure 3C:
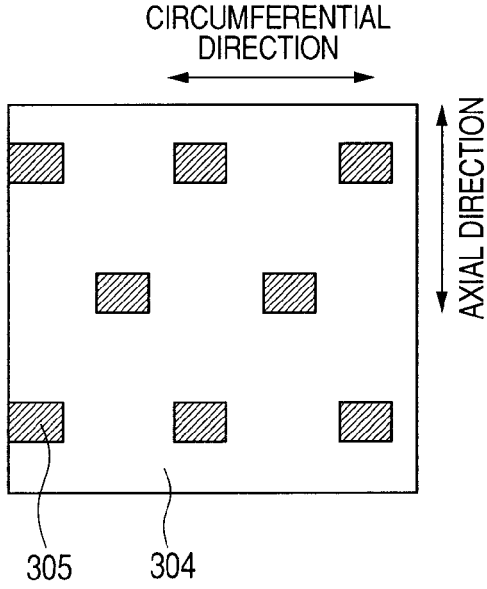
FIG. 3C illustrates a shape of the surface of the conductive substrate formed by imprinting.

FIGS. 3A, 3B and 3C are schematic diagrams of the above descriptions. As illustrated in FIG. 3A, a stainless mold 302 mounted to a mount 303 is pressurized and pressed, and a cylindrical conductive substrate 301 is rotated to form roughness in the entire surface of the conductive substrate 301. The shape of the roughness may be a groove shape (shape in which a recess 304 continuous in the circumferential direction and a protrusion 305 continuous in the circumferential direction are alternately arranged in an axial direction) as illustrated in FIG. 3B. The shape may be a discrete shape (shape in which protrusions 305 are regularly arranged) as illustrated in FIG. 3C.

(Lower Injection Preventing Layer)

In the electrophotographic photosensitive member used in the present invention, a lower injection preventing layer that serves to prevent injection of charges from the conductive substrate is effectively provided between the conductive substrate and the photoconductive layer. The lower injection preventing layer contains a relatively larger number of atoms for controlling conductivity than the photoconductive layer. As the atom contained in the lower injection preventing layer for controlling conductivity, group 13 atom or group 15 atom may be used depending on the charge polarity. Further, the lower injection preventing layer contains at least one kind of carbon atom, nitrogen atom and oxygen atom, thereby improving adhesion between the lower injection preventing layer and the conductive substrate.

The thickness of the lower injection preventing layer can be 0.1 μm to 10.0 μm (both inclusive), more preferably 0.3 μm to 5.0 μm (both inclusive), and further preferably 0.5 μm to 3.0 μm (both inclusive) in view of obtaining a desired electrophotographic property and an economic impact. The thickness of 0.1 μm or more can provide a sufficient injection preventing ability of charges from the conductive substrate, and a preferred charging ability can be obtained. Meanwhile, the thickness of 5.0 μm or less can prevent an increase in production costs due to an extended production time.

(Photoconductive Layer)

In the electrophotographic photosensitive member used in the present invention, the photoconductive layer may be made of a-Si, and group 13 atom and group 15 atom may be added as atoms for controlling conductivity. To adjust properties such as a resistance value, atoms such as oxygen atom, carbon atom, or nitrogen atom may be added. To compensate for dangling bond in the layer, hydrogen atom may be contained. The sum of the content of the hydrogen atom (H) in the photoconductive layer can be 10 atomic percent to 30 atomic percent (both inclusive) with respect to the sum of the number of silicon atoms and the number of hydrogen atoms, and more preferably 15 atomic percent to 25 atomic percent (both inclusive). Halogen atom such as fluorine may be used to obtain the same advantage as that of the hydrogen atom.

In the present invention, the thickness of the photoconductive layer can be 15 μm to 60 μm (both inclusive) in view of obtaining a desired electrophotographic property and an economic impact, more preferably 20 μm to 50 μm (both inclusive), and further preferably 20 μm to 40 μm (both inclusive).

(Surface Layer)

In the present invention, the ratio (C/(Si+C)) of the number of carbon atoms (C) to the sum of the number of silicon atoms (Si) and the number of carbon atoms (C) in the a-SiC surface layer is 0.61 to 0.75 (both inclusive), and the sum of the density of silicon atoms and the density of carbon atoms in the a-SiC surface layer is $6.60\times10^{22}$ atoms/cm$^3$ or more, and more preferably $6.81\times10^{22}$ atoms/cm$^3$ or more. As such, significant advantages can be obtained in maintaining a satisfactory cleaning property for a long time period and preventing an increase in running torque of the electrophotographic photosensitive member. The maximum sum of the density of silicon atoms and the density of carbon atoms in the a-SiC surface layer is obtained in crystal. Thus, the upper limit of the sum of the density of silicon atoms and the density of carbon atoms in the present invention is based on crystal. First, atom density of SiC crystal and diamond is used as an index, then the ratio of the density of carbon atoms to the sum of the density of silicon atoms and the density of carbon atoms in target a-SiC composition is supposed, and depending on the ratio, atom density in crystal is calculated. This atom density is the upper limit of the atom density in the target a-SiC composition. The atom density in SiC crystal with the atom densities of silicon atoms and carbon atoms being 1:1 is $9.64\times10^{22}$ atoms/cm$^3$, and the atom density in diamond as crystal only containing carbon atoms is $17.65\times10^{22}$ atoms/cm$^3$.

In the present invention, the ratio (ID/IG) of peak strength (ID) of 1390 cm$^{-1}$ to peak strength (IG) of 1480 cm$^{-1}$ in a Raman spectrum of the a-SiC surface layer can be 0.20 to 0.70 (both inclusive). The ratio of the peak strength (ID) of 1390 cm$^{-1}$ to the peak strength (IG) of 1480 cm$^{-1}$ in the Raman spectrum is hereinafter also referred to as "ID/IG". First, the Raman spectrum of the a-SiC surface layer will be described as compared to a diamond-like carbon. The diamond-like carbon is hereinafter also referred to as "DLC".

For a Raman spectrum of DLC formed of sp$^3$ structure and sp$^2$ structure, an asymmetrical Raman spectrum having a main peak near 1540 cm$^{-1}$ and a shoulder band near 1390 cm$^{-1}$ is observed. In the a-SiC surface layer formed by a RF-CVD method, a Raman spectrum having a main peak near 1480 cm$^{-1}$, and a shoulder band near 1390 cm$^{-1}$ similarly to that of DLC is observed. The main peak of the a-SiC surface layer is shifted to a lower wave number side than that of DLC because the a-SiC surface layer contains silicon atom. Thus, it is found that the a-SiC surface layer formed by the RF-CVD method is a material having a structure very similar to that of DLC.

Generally, in the Raman spectrum of DLC, it is known that sp$^3$ property of DLC tends to be higher for a smaller ratio of peak strength in a low wave number band to peak strength in a high wave number band. Thus, the a-SiC surface layer has a very similar structure to that of DLC, and it is supposed that sp$^3$ property tends to be higher for a smaller ratio of peak strength in a low wave number band to peak strength in a high wave number band. In the a-SiC surface layer having high atom density in the present invention, ID/IG in the a-SiC surface layer is set to 0.70 or less, thereby further increasing a bonding force.

This may be because an improvement in the sp$^3$ property reduces the number of two-dimensional networks of sp$^2$ and increases the number of three-dimensional networks of sp$^3$, which increases the number of bonded skeletal atoms, and allows a strong structure to be formed. Thus, smaller ID/IG in the a-SiC surface layer is desirable, but in the mass-produced a-SiC surface layer, the sp$^2$ structure cannot be completely removed. Thus, in the present invention, a lower limit value of ID/IG in the a-SiC surface layer is 0.2 at which an advantage is confirmed in this embodiment.

(Device and Method for Producing Electrophotographic Photosensitive Member of the Present Invention)

Figure 2:
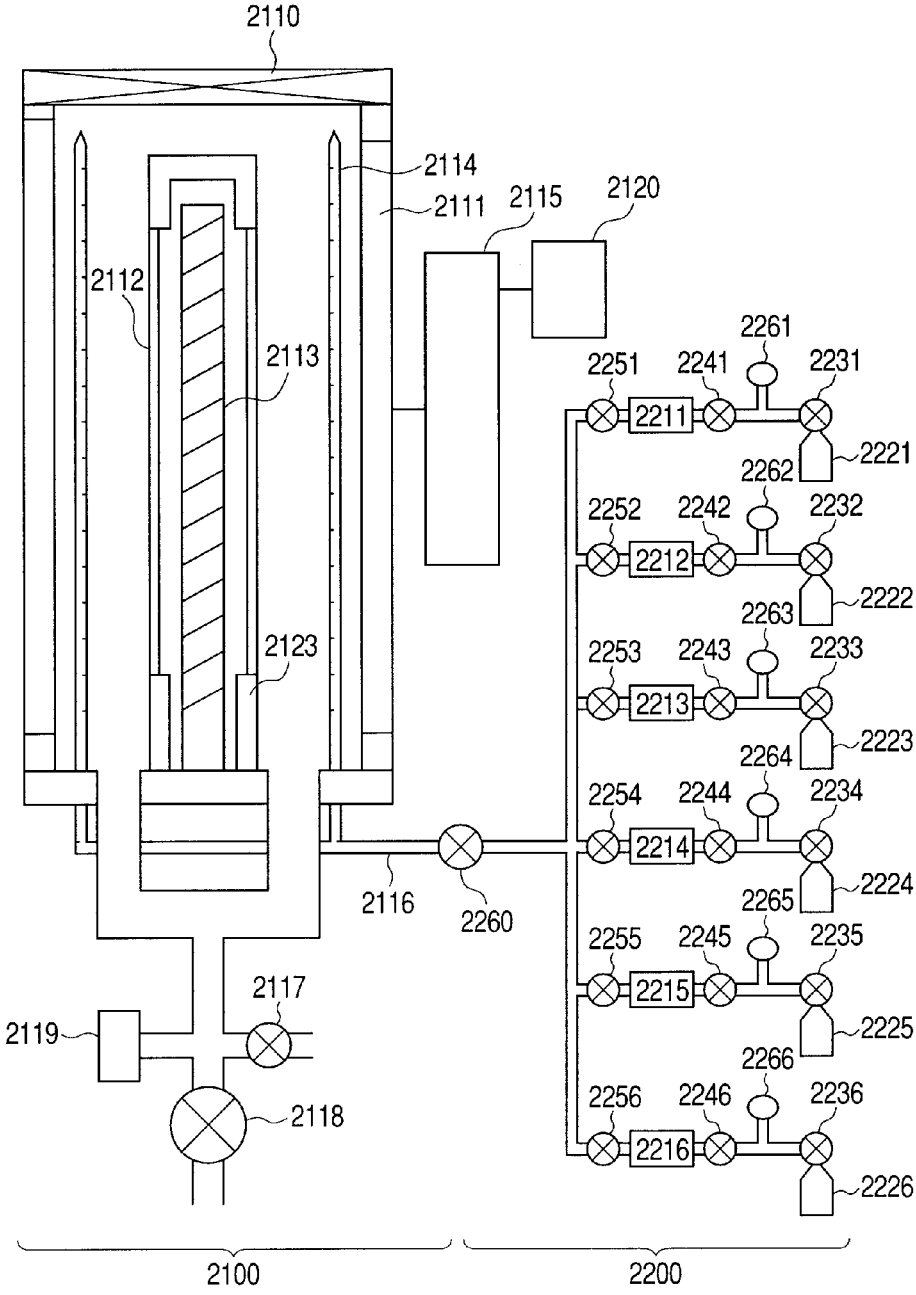
FIG. 2 illustrates an example of a configuration of a plasma CVD deposition apparatus.

FIG. 2 illustrates an example of a configuration of a plasma CVD deposition apparatus, and specifically illustrates a production apparatus (deposition apparatus) of an electrophotographic photosensitive member by an RF plasma CVD method using a radiofrequency power supply. This apparatus mainly includes a deposition apparatus 2100, a supply apparatus 2200 of a source gas, and an exhaust apparatus (not shown) for reducing pressure in the deposition chamber 2110. In the deposition chamber 2110, a conductive substrate 2112 connected to the earth, a heater 2113 for heating the conductive substrate, and a gas introducing pipe 2114 are provided. Further, a radiofrequency power supply 2120 is connected via a radiofrequency matching box 2115.

The gas supply apparatus 2200 includes source gas bombs 2221, 2222, 2223, 2224, 2225 and 2226, valves 2231, 2232, 2233, 2234, 2235 and 2236, valves 2241, 2242, 2243, 2244, 2245 and 2246, valves 2251, 2252, 2253, 2254, 2255 and 2256, and mass flow controllers 2211, 2212, 2213, 2214, 2215 and 2216. Each of the source gas bombs is connected via a valve 2260 to the gas introducing pipe 2114 in the deposition chamber 2110. The conductive substrate 2112 is provided on a conductive cradle 2123 and thus connected to the earth.

Now, an example of a procedure of a method of forming the electrophotographic photosensitive member using the apparatus in FIG. 2 will be described. The conductive substrate 2112 is provided in the deposition chamber 2110, and the unshown exhaust apparatus (for example, a vacuum pump) exhausts gas from the inside of the deposition chamber 2110. Then, the heater 2113 for heating the conductive substrate controls a temperature of the conductive substrate 2112 to a desired temperature of 50° C. to 350° C. Then, to cause the source gas for forming each layer of the electrophotographic photosensitive member to flow into the deposition chamber 2110, it is first confirmed that valves 2231, 2232, 2233, 2234, 2235 and 2236 of the gas bombs and a leak valve 2117 of the deposition chamber are closed. It is also confirmed that inflow valves 2241, 2242, 2243, 2244, 2245 and 2246, outflow valves 2251, 2252, 2253, 2254, 2255 and 2256, and an auxiliary valve 2260 are opened, and a main valve 2118 is opened to exhaust gas from the deposition chamber 2110 and a gas supply pipe 2116.

Then, at the time when a vacuum gauge 2119 reads predetermined pressure of 1 Pa or less, the auxiliary valve 2260 and the outflow valves 2251, 2252, 2253, 2254, 2255 and 2256 are closed. Then, gases are introduced from the gas bombs 2221, 2222, 2223, 2224, 2225 and 2226 by opening the valves 2231, 2232, 2233, 2234, 2235 and 2236, and pressure adjustors 2261, 2262, 2263, 2264, 2265 and 2266 adjust each gas pressure to 0.2 MPa. Then, the inflow valves 2241, 2242, 2243, 2244, 2245 and 2246 are gradually opened to introduce each gas into the mass flow controller 2211, 2212, 2213, 2214, 2215 and 2216.

After deposition preparation is completed by the above-described procedure, for example, a photoconductive layer is formed on the conductive substrate 2112. Specifically, when the conductive substrate 2112 reaches a desired temperature, a required one of the outflow valves 2251, 2252, 2253, 2254, 2255 and 2256 and the auxiliary valve 2260 are gradually opened. By this operation, a desired source gas is introduced from the gas bombs 2221, 2222, 2223, 2224, 2225 and 2226 via the gas introducing pipe 2114 into the deposition chamber 2110. Then, the mass flow controllers 2211, 2212, 2213, 2214, 2215 and 2216 adjust each source gas to have a desired flow rate. At this time, an opening of the main valve 2118 is adjusted while the vacuum gauge 2119 is checked so that the inside of the deposition chamber 2110 has desired pressure. When the internal pressure is stabilized, the radiofrequency power supply 2120 is set to desired electric power. For example, radiofrequency power having a frequency of 1 MHz to 50 MHz, for example, 13.56 MHz is supplied through the radiofrequency matching box 2115 to a cathode electrode 2111 to cause radiofrequency glow discharge. The discharge energy decomposes each source gas introduced into the deposition chamber 2110, and a photoconductive layer mainly made of desired amorphous silicon is deposited on the conductive substrate 2112.

After the layer having a desired thickness is formed, the supply of the radiofrequency power is stopped, and the outflow valves 2251, 2252, 2253, 2254, 2255 and 2256 are closed to stop inflow of each source gas into the deposition chamber 2110 to finish forming the photoconductive layer. Known composition or thickness of the photoconductive layer may be used. When the surface layer is continuously deposited or when the lower injection preventing layer is deposited between the photoconductive layer and the conductive substrate 2112, the operation as described above may be basically performed. After the layers are formed on the conductive substrate 2112 in this manner, the processes of exhausting the gas in the deposition chamber 2110, introducing an inactive gas such as argon (Ar) gas, and exhausting the gas is repeated to purge the gas used for layer forming. Such an operation is repeated a plurality of times, the deposition chamber 2110 is cooled and the deposition chamber 2110 is returned to atmospheric pressure by an inactive gas such as nitrogen ($N_2$) gas, and then the electrophotographic photosensitive member is taken out of the deposition chamber 2110.

The electrophotographic photosensitive member of the present invention has increased densities of silicon atoms and carbon atoms that form a-SiC, and forms a surface layer having a layer structure with high atom density as compared to a conventionally known surface layer of the electrophotographic photosensitive member. As described above, when the a-SiC surface layer having high atom density of the present invention is formed, generally, a smaller amount of gas supplied to a reaction container and higher radiofrequency power are better although depending on the condition in forming the surface layer. Also, higher pressure in the reaction container and higher temperature of the conductive substrate are better. Reducing the amount of gas supplied into the reaction container, and increasing the radiofrequency power can facilitate decomposing of the gas. Thus, carbon atom supply source (for example, $CH_4$) that is harder to decompose than silicon atom supply source (for example, $SiH_4$) can be efficiently decomposed. Thus, an active species with a small number of hydrogen atoms is produced to reduce the number of hydrogen atoms in the layer deposited on the conductive substrate, thereby allowing an a-SiC surface layer with high atom density to be formed.

Increasing the pressure in the reaction container increases a retention time of the source gas supplied into the reaction container. It is supposed that the hydrogen atom generated by decomposing of the source gas causes a abstration reaction of weak bonding hydrogen, facilitating networking of the silicon atoms and the carbon atoms. Further, increasing the temperature of the conductive substrate increases a surface migrating distance of the active species having reached the conductive substrate, thereby allowing more stable bonding. Thus, as the a-SiC surface layer, the atoms can be bound in a more structurally stable arrangement.

(Electrophotographic Apparatus)

Figure 5:
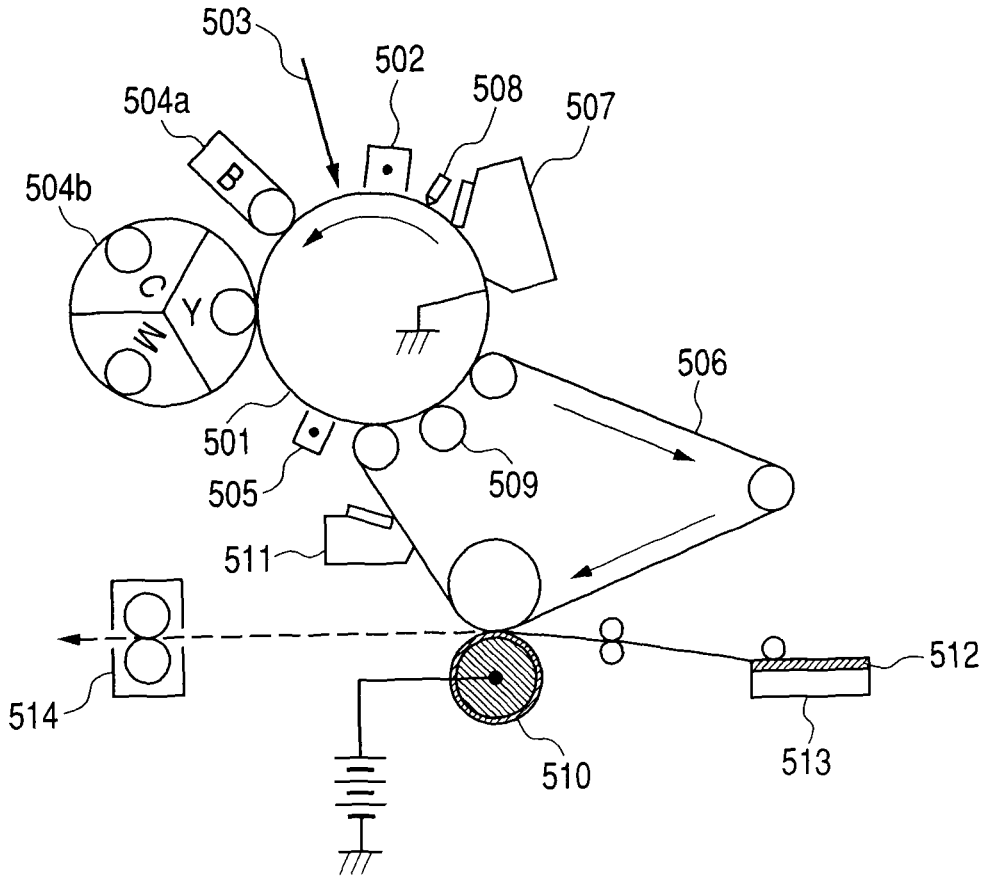
FIG. 5 illustrates an example of a configuration of an electrophotographic apparatus.

The electrophotographic apparatus suitably used in the present invention will be described with reference to a schematic configuration diagram in FIG. 5. The electrophotographic apparatus includes a drum-shaped electrophotographic photosensitive member 501 in which an electrostatic latent image is formed on a surface, and toner is applied on the electrostatic latent image to form a toner image. Around the electrophotographic photosensitive member 501, a primary charger (charging unit) 502 that uniformly charges the surface of the electrophotographic photosensitive member 501 to a predetermined polarity and potential, and an unshown image exposure apparatus (image exposure unit) that applies an image exposure light (latent image forming light) 503 to the charged surface of the electrophotographic photosensitive member 501 to form an electrostatic latent image are placed. As a developer (developing unit) that applies toner on the formed electrostatic latent image and develops the image, a first developer **504*a* that applies black toner B and a second developer 504*b* that applies color toner and develops the image are placed. The second developer 504*b*** is a rotatable developer including a developer that applies yellow toner Y, a developer that applies magenta toner M, and a developer that applies a cyan toner C.

A pre-transfer charger 505 is provided for making uniform charges of toner that forms a toner image on the surface of the electrophotographic photosensitive member 501, and performing stable transfer. Further, a photosensitive member cleaner (cleaning unit for the electrophotographic photosensitive member) 507 is provided for cleaning on the electrophotographic photosensitive member 501 after the toner image is transferred to an intermediate transfer belt 506. To the electrophotographic photosensitive member 501, a discharge light 508 for discharge is applied. The intermediate transfer belt 506 is placed to drive the electrophotographic photosensitive member 501 via an abutment nip portion, and inside the belt, a primary transfer roller 509 for transferring a toner image formed on the electrophotographic photosensitive member 501 to the intermediate transfer belt 506 is provided.

To the primary transfer roller 509, a bias power supply (not shown) is connected that applies a primary transfer bias for transferring the toner image on the electrophotographic photosensitive member 501 to the intermediate transfer belt 506. Around the intermediate transfer belt 506, a secondary transfer roller 510 for further transferring the toner image transferred to the intermediate transfer belt 506 to a transfer material 512 is provided in contact with a lower surface of the intermediate transfer belt 506. To the secondary transfer roller 510, a bias power supply that applies a secondary transfer bias for transferring the toner image on the intermediate transfer belt 506 to the transfer material 512 is connected. An intermediate transfer belt cleaner (cleaning unit for the intermediate transfer belt) 511 is provided for cleaning transfer residual toner remaining on the surface of the intermediate transfer belt 506 after the toner image on the intermediate transfer belt 506 is transferred to the transfer material 512.

The electrophotographic apparatus includes a paper feed cassette 513 holding a plurality of transfer materials 512 on which images are formed, and a conveyor mechanism that conveys the transfer materials 512 from the paper feed cassette 513 via the abutment nip portion between the intermediate transfer belt 506 and the secondary transfer roller 510. On a conveying path of the transfer material 512, a fixing apparatus 514 is placed that fixes the toner image transferred on the transfer material 512 onto the transfer material 512. As the image exposure apparatus, a color separation/image forming exposure optical system of a color original image, or a scan exposure system using a laser scanner that outputs a laser beam modulated correspondingly to time-series electrical digital pixel signals of image information is used. With such an exposure system, according to an image pattern, a laser or a light beam from an LED as a light source can be applied for each pixel of a pixel matrix of a plurality of rows and columns to form an electrostatic latent image on the surface of the electrophotographic photosensitive member 501.

Next, an operation of the electrophotographic apparatus will be described. First, as shown by an arrow in FIG. 5, the electrophotographic photosensitive member 501 is rotationally driven counterclockwise at a predetermined circumferential velocity (process speed), and the intermediate transfer belt 506 is rotationally driven clockwise at the same circumferential velocity as the electrophotographic photosensitive member 501. The electrophotographic photosensitive member 501 is uniformly charged to a predetermined polarity and potential by the primary charger 502 in the rotation process. Then, the image exposure light 503 is applied to the electrophotographic photosensitive member 501, and thus an electrostatic latent image corresponding to a first color component image (for example, a magenta component image) of a target color image is formed on the surface of the electrophotographic photosensitive member 501. Then, the second developer 504*b* is rotated, the developer that applies the magenta toner M is set in a predetermined position, and an electrostatic latent image thereof is developed by the magenta toner M as a first color. At this time, the first developer 504*a* is off, and does not act on the electrophotographic photosensitive member 501, and does not affect the magenta toner image of the first color.

Then, the magenta toner image of the first color formed on the electrophotographic photosensitive member 501 is intermediately transferred to the surface of the intermediate transfer belt 506. At this time, in the process of the magenta toner image passing through the nip portion between the electrophotographic photosensitive member 501 and the intermediate transfer belt 506, the primary transfer bias is applied from a bias power supply (not shown) to the primary transfer roller 509. Transfer is performed by an electric field applied by the above operation. The surface of the electrophotographic photosensitive member 501 having transferred the magenta toner image of the first color to the intermediate transfer belt 506 is cleaned by the photosensitive member cleaner 507. Then, on the cleaned surface of the electrophotographic photosensitive member 501, a toner image of a second color (for example, a cyan toner image) is formed similarly to the formation of the toner image of the first color, and the toner image of the second color is superimposed on and transferred to the surface of the intermediate transfer belt 506 to which the toner image of the first color is transferred. Hereinafter, similarly, a toner image of a third color (for example, a yellow toner image), and a toner image of a fourth color (for example, a black toner image) are successively superimposed on and transferred to the surface of the intermediate transfer belt 506, and a synthesized color toner image corresponding to a target color image is formed.

Next, the transfer material 512 is fed from the paper feed cassette 513 to the abutment nip portion between the intermediate transfer belt 506 and the secondary transfer roller 510 at predetermined timing. The secondary transfer roller 510 abuts against the intermediate transfer belt 506, and the secondary transfer bias is applied from the bias power supply to the secondary transfer roller 510. Thus, the synthesized color toner image superimposed on and transferred to the surface of the intermediate transfer belt 506 is transferred to the transfer material 512 as a second image supporting member. After the toner image is transferred to the transfer material 512, transfer residual toner on the surface of the intermediate transfer belt 506 is cleaned by the intermediate transfer belt cleaner 511. The transfer material 512 to which the toner image is transferred is guided to the fixing device 514, where the toner image is heated and fixed on the transfer material 512. In the operation of the electrophotographic apparatus, when the toner images of the first to fourth color are successively transferred from the electrophotographic photosensitive member 501 to the intermediate transfer belt 506, the secondary transfer roller 510 and the intermediate transfer belt cleaner 511 may be spaced apart from the intermediate transfer belt 506.

Now, the present invention will be described in more detail with examples, but the present invention is not limited to the examples.

Example 1

An aluminum cylinder (conductive substrate) was set in a lathe and cut to have an outer diameter of 84 mm. Tool feed was adjusted in a range of 0.01 mm/rotation to 0.15 mm/rotation (both inclusive). A cutting amount was 0.4 mm, and a tool application angle and a feed speed were adjusted to form a desired shape. For a cylinder having small Ra, a flat tool was used, and for a cylinder having Ra of 1 μm or more, a straight tool was used. As indicated in Table 2, a cylinder with a pitch (Rsm) of 8 μm to 155 μm (both inclusive) was processed by the lathe.

A cylinder having a pitch (Rsm) of 0.8 μm to 12 μm (both inclusive) was processed by imprinting. As a shape of roughness, a groove shape (shape in which a recess 304 continuous in a circumferential direction and a protrusion 305 continuous in the circumferential direction are alternately arranged in an axial direction) as illustrated in FIG. 3B was used. At this time, an area of the protrusion 305 was set to 35% with respect to the sum of an area of the recess 304 and the area of the protrusion 305. Cycles of the protrusion were 0.8 μm, 1.0 μm, 10.0 μm, and 12.0 μm, the sectional shape of the protrusion had a square, and pressing pressure was changed to change a depth of the recess as indicated in Table 2. The conductive substrates thus processed were placed in a plasma CVD apparatus illustrated in FIG. 2, and under the condition indicated in Table 1, deposition layers including a lower injection preventing layer, a photoconductive layer, and a surface layer were successively formed.

Surface roughness of the electrophotographic photosensitive member thus obtained was measured using a surface roughness measuring apparatus (form tracer SV-C4000S4 produced by Mitutoyo Corporation). A stylus having a taper angle of 60 degrees and a tip of R=2 μm was used to measure with a measurement force of 0.75 mN. A cutoff value complied with JIS B 0651:2001. At this time, the groove with a narrow pitch formed by imprinting could not be precisely measured, and thus measured by an atomic force microscope (hereinafter referred to as "AFM") (Q-Scope 250 produced by Quesant Instrument Corporation) in an auxiliary manner. Shapes corresponding to Ra, Rsm, and Rzjis obtained by a stylus method was measured by the AFM, and a roughness curve was estimated. From the obtained roughness curve, Ra, Rsm, and Rzjis were calculated according to JIS B 0601: 2001. Ra refers to arithmetic average roughness, which is an essential parameter in the present invention. Rsm refers to lateral regularity, which corresponds to a cycle. Rzjis refers to a ten point average height of peaks and valleys, which corresponds to a depth. However, since there may be variations depending on the cycle structure, the same measurement was repeated five times to take an average value, which was defined as a depth.

The conductive substrate cut as described above was used to measure Ra of the electrophotographic photosensitive member on which the deposited layer was formed by roughness curve measurement, and Ra and the shape were sorted, and then the electrophotographic photosensitive member as indicated in Table 2 is selected. At this time, for processing conditions 1-1 to 1-6, 1-8 to 1-13, 1-15 to 1-17, 1-19, 1-21, 1-23, 1-25, 1-26, and 1-29 to 1-31, Rzjis of the surface shape of the conductive substrate was 0.100 μm to 2.000 μm (both inclusive), and Rsm was 1.0 μm to 150.0 μm (both inclusive). For processing conditions 1-25, 1-26, and 1-28 to 1-30, the shape of the surface was formed by imprinting, and Rsm was 1.0 μm to 10 μm (both inclusive). For processing conditions 1-1 to 1-6, 1-9, 1-10, 1-15 to 1-18, and 1-23, the shape of the surface was formed by a lathe, and Rsm was 10.0 μm to 30.0 μm (both inclusive). An endurance test described below was performed with these electrophotographic photosensitive members. The composition and density of the surface layer were obtained by analyzing a surface layer previously formed by the same forming method to determine a formation condition.

(Measurement of C/(Si+C), Si+C Atom Density, and H/(Si+C+H))

First, a reference electrophotographic photosensitive member including only a lower injection preventing layer and a photoconductive layer in Table 1 was produced, and a middle portion in a longitudinal direction in any circumferential direction was cut into a 15 mm×15 mm square to produce a reference sample. Then, an electrophotographic photosensitive member including a lower injection preventing layer, a photoconductive layer, and a surface layer was similarly cut to produce a measurement sample. The reference sample and the measurement sample were measured by a spectral ellipsometry (high speed spectral ellipsometry M-2000 produced by J.A. Woollam Co., Inc.) to calculate a thickness of the surface layer.

Specific measurement conditions of the spectral ellipsometry are incident angles of 60°, 65° and 70°, a measurement wavelength of 195 nm to 700 nm (both inclusive), and a beam diameter of 1 mm×2 mm. First, for the reference sample, relationships between a wavelength and an amplitude ratio ψ and between a wavelength and a phase difference Δ at each incident angle were calculated by the spectral ellipsometry. Then, using the measurement result of the reference sample as a reference, for the measurement sample, relationships between a wavelength and an amplitude ratio ψ and between a wavelength and a phase difference Δ at each incident angle were calculated by the spectral ellipsometry similarly to the reference sample.

Next, an electrophotographic photosensitive member successively including a lower injection preventing layer, a photoconductive layer, and a surface layer was produced. A layer configuration including a roughness layer in which the surface layer and an air layer exist together in a top surface was used as a calculation model. A volume ratio between the surface layer and the air layer in the roughness layer was changed by analysis software, and the relationships between the wavelength and the amplitude ratio ψ and between the wavelength and the phase difference Δ at each incident angle were obtained by calculation. Then, a calculation model was selected at the time of a minimum mean square error of the relationships between the wavelength and the amplitude ratio ψ and between the wavelength and the phase difference Δ at each incident angle obtained by the above-described calculation and the relationships between the wavelength and the amplitude ratio ψ and between the wavelength and the phase difference Δ calculated by measuring the measurement sample. The thickness of the surface layer was calculated by the selected calculation model, and the obtained value was set as the thickness of the surface layer. As the analysis software, WVASE 32 produced by J.A. Woollam Co., Inc. was used. Also, for the volume ratio between the surface layer and the air layer in the roughness layer, it was calculated by changing the ratio of the air layer in the roughness layer in increments of one from the surface layer to the air layer of 10:0 to 1:9. A positive charging a-Si photosensitive member produced under the deposition condition of the example, a minimum error between calculation and measurement was obtained when the volume ratio between the surface layer and the air layer in the roughness layer was 8:2. Specifically, under the above-described conditions, a minimum mean square error was obtained of the relationships between the wavelength and the amplitude ratio ψ and between the wavelength and the phase difference Δ obtained by the calculation and the relationships between the wavelength and the amplitude ratio ψ and between the wavelength and the phase difference Δ calculated by measurement.

After measurement by the spectral ellipsometry was finished, for the measurement sample, RBS (Rutherford backscattering method) (backscattering measurement apparatus AN-2500 produced by NHV Corporation) was used to measure the numbers of silicon atoms and carbon atoms in the surface layer in the measurement area of RBS. From the measured numbers of silicon atoms and carbon atoms, C/(Si+C) was calculated. Then, for the silicon atoms and the carbon atoms calculated from the measurement area of RBS, the thickness of the surface layer calculated by the spectral ellipsometry was used to calculate the Si atom density, the C atom density, and the Si+C atom density. Simultaneously with RBS, for the measurement sample, HFS (hydrogen front scattering method) (backscattering measurement apparatus AN-2500 produced by Nisshin High Voltage Co. Ltd.) was used to measure the number of hydrogen atoms in the surface layer in the measurement area of HFS. From the number of hydrogen atoms calculated from the measurement area of HFS and the numbers of silicon atoms and carbon atoms calculated from the measurement area of RBS, H/(Si+C+H) was calculated.

Then, for the number of hydrogen atoms calculated from the measurement area of HFS, the thickness of the surface layer calculated by the spectral ellipsometry was used to calculate the H atom density. Specific measurement conditions of RBS and HFS were an incident ion of 4 $He^+$, incident energy of 2.3 MeV, an incident angle of 75°, a sample current of 35 nA, and an incident beam diameter of 1 mm. A detector of RBS performed measurement with a scattering angle of 160° and an aperture diameter of 8 mm, and a detector of HFS performed measurement with a recoil angle of 30° and an aperture diameter of 8 mm+Slit. From an analysis under the above-described conditions, the surface layer formed under the condition in Table 1 had C/(Si+C) of 0.72, and Si+C atom density of $6.9\times10^{22}$ atoms/$cm^3$. H/(Si+C+H) was 0.41.

Next, each electrophotographic photosensitive member was placed in an electrophotographic apparatus (iRC 6800 produced by Canon Inc. modified for the test), and the below-described test was performed. This modified apparatus drives the electrophotographic photosensitive member with an external motor connected via a torque meter (transducer STQ-2NM-11009 produced by TEAC Corporation). A cleaning blade having type A hardness of 80 degrees according to JIS K6253 was used and applied at linear pressure of 40 gf/cm. Toner having an average particle size of 6.0 μm was used. With such a modified apparatus and under such conditions, a halftone image was first output to check whether moire occurs or not (presence or absence of moire). The moire was evaluated by ranking as described below.

A . . . Moire did not occur.

E . . . Moire occurred.

In this ranking, it was determined that the advantage of the present invention was obtained in A.

Next, initial running torque (initial torque) of an electrophotographic photosensitive member was measured. An electrophotographic photosensitive member (electrophotographic photosensitive member 1-32 of Comparative example 1) produced by a mirror finished conductive substrate was used as a reference, and relative evaluation was performed with ranking described below.

A . . . Torque was reduced 50% or more as compared to that of the electrophotographic photosensitive member 1-32.

B . . . Torque was reduced 30% or more and less than 50% as compared to that of the electrophotographic photosensitive member 1-32.

C . . . Torque was reduced 10% or more and less than 30% as compared to that of the electrophotographic photosensitive member 1-32.

D . . . Torque was equal to or reduced less than 10% as compared to that of the electrophotographic photosensitive member 1-32.

E . . . Torque was increased as compared to that of the electrophotographic photosensitive member 1-32.

In this ranking, it was determined that the advantage of the present invention was obtained in C or more.

Next, the above-described electrophotographic apparatus was used to conduct an endurance test for 500 thousands sheets. After the endurance test, the running torque (torque after enduring) of the electrophotographic photosensitive member was evaluated again, and relative evaluation was performed with the same ranking. Also, evaluation of passage in cleaning was performed as described below. A cleaning blade having type A hardness of 80 degrees according to JIS K6253 was used. Toner containing an external additive 2.5 times more than normal toner was used in this test. An external additive such as silica has a fine particle size and is hard to clean. Further, a large amount of external additive increases fluidity of toner, which may make cleaning difficult. Under such conditions, linear pressure for pressing the cleaning blade was changed, and minimum linear pressure was calculated at which passage of toner or an external additive such as silica does on the drum not occur when visually checked.

In the electrophotographic photosensitive member 1-32 of Comparative example 1, there was passage of a trace amount of external additive at linear pressure of less than 50 g/cm. This value was used as a reference, and passage (initial passage) was evaluated with below described ranking.

A . . . Passage occurred at linear pressure of less than 35 g/cm.

B . . . Passage occurred at linear pressure of 35 g/cm or more and less than 40 g/cm.

C . . . Passage occurred at linear pressure of 40 g/cm or more and less than 45 g/cm.

D . . . Passage occurred at linear pressure of 45 g/cm or more and less than 50 g/cm (equal to that of the electrophotographic photosensitive member 1-32).

E . . . Passage also occurred at linear pressure of 50 g/cm or more.

In this ranking, it was determined that the advantage of the present invention was obtained in C and more.

Cleaning latitude was evaluated as described below. Seven springs with different constants of spring were prepared, and linear pressure for pressing the cleaning blade was changed to check whether a cleaning failure occurred or not. Generally, with too low linear pressure, toner having a small particle size passes through, and too high linear pressure causes chatter and prevents uniform cleaning in many cases. A range (latitude) of linear pressure in which the passage and chatter do not occur was evaluated in an initial stage and after the endurance test for 500 thousands sheets. Larger latitude refers to higher stability in cleaning. The electrophotographic photosensitive member (electrophotographic photosensitive member 1-32 of Comparative example 1) produced by the mirror finished conductive substrate was used as a reference, and relative evaluation of the latitude (cleaning latitude) was performed with ranking described below.

A . . . Latitude was increased 50% or more both in the initial stage and after the endurance test as compared to the electrophotographic photosensitive member 1-32.

B . . . Latitude was increased less than 50% both in the initial stage and after the endurance test as compared to the electrophotographic photosensitive member 1-32.

C . . . Latitude was equal to that of the electrophotographic photosensitive member 1-32 in the initial stage but increased after the endurance test as compared to the electrophotographic photosensitive member 1-32.

D . . . Latitude was equal to that of the electrophotographic photosensitive member 1-32.

E . . . Latitude was less than that of the electrophotographic photosensitive member 1-32.

In this ranking, it was determined that the advantage of the present invention was obtained in C and more.

The electrophotographic photosensitive member was taken out again after the endurance test for 500 thousand sheets to perform reflection spectrometry of the surface. As an evaluation method, reflection spectral waveforms of the electrophotographic photosensitive member were measured at 9 points in a longitudinal direction in any circumferential direction of the electrophotographic photosensitive member (0 mm, ±50 mm, ±90 mm, ±130 mm, ±150 mm with reference to a center in the longitudinal direction of the electrophotographic photosensitive member). The 9 points in the longitudinal direction were measured at positions rotated 180° from the any circumferential direction, and 18 points in sum were measured. Then, reflection spectral results previously measured before the endurance test and the waveforms were compared. For measurement, a light was vertically applied to the surface of the electrophotographic photosensitive member with a spot diameter of 2 mm, and a spectrometer (MCPD-2000 produced by OTSUKA ELECTRONICS CO., LTD.) was used to perform spectrometry of a reflected light. At this time, a wavelength range was set to 400 nm to 750 nm (both inclusive), and maximum and minimum values were calculated in this range. When the sum of the number of maximum and minimum values in the wavelength range is an odd number, one maximum or minimum value on the longest wavelength side was discarded to select even-numbered values. An average value of reflectivity at the maximum and minimum values was calculated, and defined as a reflectivity central value.

The reflectivity central value was measured before the endurance test (in the initial stage) and after the endurance test, the values at the same measurement point were compared, and the degree of increase or decrease of the values before and after the endurance test was calculated. In view of variations in measurement, the differences at the 18 points are averaged to estimate the amount of change in the reflectivity central value of a corresponding photosensitive member. When the reflectivity central value was significantly increased, it was determined that flattening due to cutting of the surface occurred. Meanwhile, when the reflectivity central value was significantly decreased, it was determined that a material such as a reflection preventing layer was formed on the surface of the electrophotographic photosensitive member. The obtained result was indicated in Table 2 together with the result of Comparative example 1. General determination in Table 2 placed importance on a point at a lowest rank in the above-described evaluation. For example, even with one E rank, general determination was made as the E rank. Also in ranking of general evaluation, it was determined that the advantage of the present invention was obtained in C and more.

Comparative Example 1

Ra of 0.025 μm and 0.52 μm were sorted by the same production method as in Example 1, and the same evaluation as in Example 1 was performed. The obtained result was indicated in Table 2 together with the result of Example 1. In Example 1, moire did not occur in the entire Ra range from the initial stage, and running torque of the electrophotographic photosensitive member in the initial stage were reduced 10% or more as compared to that of the electrophotographic photosensitive member 1-32 as the reference, and a good result was obtained. Also, even after the endurance test for 500 thousand sheets, the running torque of the electrophotographic photosensitive member was hardly increased, and torque was relatively reduced as compared to that of the electrophotographic photosensitive member 1-32 with the increase in running torque. Thus, it is supposed that there is a low possibility that a long-term use causes a banding phenomenon due to an increase in running torque of the electrophotographic photosensitive member. Also, the reflectivity central value obtained from the reflection spectral waveform was about 12% in the initial stage, while after the endurance test, the reflectivity central value was increased by about 1 to 4 points or was substantially the same in all the electrophotographic photosensitive members. This may be because microscopic protrusions on the surface of the electrophotographic photosensitive member were slightly cut and microscopic roughness was shifted to be flat, thereby slightly increasing reflectivity.

When the electrophotographic photosensitive members 1-1 to 1-6 were noted and compared substantially at the same pitch, the best result was obtained from the photosensitive member under processing conditions with Ra in a range of 0.050 to 0.200 (both inclusive). Generally, with a depth of roughness of a certain value or more, the running torque of the electrophotographic photosensitive member in the initial stage tended to be smaller. With a pitch of a certain value or more, passage of the external additive tended to be more difficult. When the depth of the roughness and the pitch were in appropriate ranges, cleaning latitude tended to be further increased. Meanwhile, for the electrophotographic photosensitive member 1-32 having Ra of 0.025 μm in Comparative example 1, torque was relatively higher from the initial stage than that of the electrophotographic photosensitive member in Example 1, and after the endurance test for 500 thousand sheets, the running torque of the electrophotographic photosensitive member was increased. If the running torque is continuously increased, a cleaning failure or a banding phenomenon may occur. Thus, in view of demands in the POD market, it is desirable that the running torque is not increased.

Also, the cleaning latitude after the endurance test tended to be reduced. Specifically, even if a cleaning failure did not occur before the endurance test, the endurance test changed the state of the surface of the electrophotographic photosensitive member, which could cause a cleaning failure after the endurance test in some cases. Thus, it was found that further increased latitude was desired when extremely high image quality was demanded. For the electrophotographic photosensitive member 1-33 having Ra of 0.520 μm in Comparative example 1, slight moire was observed when a halftone image was output although the moire has a concentration difference acceptable in normal office use. For such moire, the POD market or the graphic art market requires a very strict standard, and thus it was found the electrophotographic photosensitive member was hard to satisfy the standard.

From the above results, it was found that when the composition and density of the surface layer were set in suitable ranges in the present invention, Ra of the surface of the electrophotographic photosensitive member had to be 0.029 μm to 0.500 μm (both inclusive). At this time, it was found that a satisfactory cleaning property was obtained from the initial stage, the running torque of the electrophotographic photosensitive member was not increased, and moire did not appear. Further, it was found that particularly desirable Ra was 0.050 μm to 0.200 μm (both inclusive). It was also found that the surface could have a shape with a depth of 0.10 μm to 2.00 μm (both inclusive), more preferably 0.5 μm to 1.5 μm (both inclusive), and a cycle of 1.0 μm to 150 μm (both inclusive), more preferably 10 μm to 30 μm (both inclusive).

TABLE 1

| Gas type/condition | Lower injection preventing layer | Photoconductive layer | Surface layer |
|---|---|---|---|
| $SiH_4$ [ml/min(normal)] | 350 | 450 | 26 |
| $H_2$ [ml/min(normal)] | 750 | 2200 | |
| $CH_4$ [ml/min(normal)] | | | 360 |
| $B_2H_6$ [ppm (to $SiH_4$)] | 1500 | 1 | |
| NO [ml/min (normal)] | 10 | | |
| Substrate temperature [° C.] | 260 | 260 | 290 |
| Pressure [Pa] | 40 | 80 | 80 |
| RF power [W] | 400 | 800 | 700 |
| Layer thickness [μm] | 3 | 25 | 0.5 |

TABLE 2

| | Processing Processing condition No. | Surface layer property: Composition C/(Si + C) | Surface layer property: Density atom/cm$^3$ | Processing method Lathe or imprinting | Surface roughness μm: Ra | Surface roughness μm: Rsm | Surface roughness μm: Rzjis | Evaluation result: Presence or absence of moire | Initial torque | Initial passage | Torque after endurance | Latitude | Reflectivity central value | General determination |
|---|---|---|---|---|---|---|---|---|---|---|---|---|---|---|
| Ex. 1 | 1-1 | 0.72 | $6.90 \times 10^{22}$ | Lathe | 0.029 | 30 | 0.115 | A | B | A | A | B | 2 points increase | B |
| | 1-2 | | | | 0.050 | 30 | 0.521 | A | A | A | A | A | 2 points increase | A |
| | 1-3 | | | | 0.099 | 29 | 0.537 | A | A | A | A | A | 2 points increase | A |
| | 1-4 | | | | 0.199 | 30 | 0.867 | A | A | A | A | A | 3 points increase | A |
| | 1-5 | | | | 0.250 | 30 | 1.568 | A | A | A | A | B | 3 points increase | B |
| | 1-6 | | | | 0.499 | 30 | 1.965 | A | A | A | A | B | 4 points increase | B |
| | 1-7 | | | | 0.030 | 120 | 0.097 | A | C | A | A | C | 2 points increase | C |
| | 1-8 | | | | 0.035 | 40 | 0.105 | A | B | A | A | B | 2 points increase | B |
| | 1-9 | | | | 0.034 | 30 | 0.106 | A | B | A | A | B | 1 point increase | B |
| | 1-10 | | | | 0.104 | 30 | 0.482 | A | B | A | A | B | 2 points increase | B |
| | 1-11 | | | | 0.113 | 8 | 0.509 | A | A | B | A | B | 2 points increase | B |
| | 1-12 | | | | 0.112 | 35 | 0.501 | A | A | A | A | B | 2 points increase | B |
| | 1-13 | | | | 0.109 | 150 | 0.503 | A | A | A | A | B | 1 point increase | B |
| | 1-14 | | | | 0.045 | 155 | 0.512 | A | A | A | A | C | 3 points increase | C |
| | 1-15 | | | | 0.117 | 30 | 0.504 | A | A | A | A | A | 2 points increase | A |
| | 1-16 | | | | 0.195 | 30 | 1.494 | A | A | A | A | A | 3 points increase | A |
| | 1-17 | | | | 0.461 | 30 | 1.981 | A | A | A | A | B | 4 points increase | B |
| | 1-18 | | | | 0.469 | 30 | 2.018 | A | A | A | A | C | 4 points increase | C |
| | 1-19 | | | | 0.033 | 150 | 0.102 | A | B | A | A | B | 2 points increase | B |
| | 1-20 | | | | 0.032 | 150 | 0.095 | A | C | A | A | C | 1 point increase | C |
| | 1-21 | | | | 0.486 | 150 | 1.991 | A | A | A | A | B | 2 points increase | B |
| | 1-22 | | | | 0.491 | 150 | 2.015 | A | A | A | A | C | 3 points increase | C |
| | 1-23 | | | | 0.192 | 10 | 1.495 | A | A | A | A | A | 2 points increase | A |
| | 1-24 | | | Imprinting | 0.202 | 0.8 | 0.815 | A | A | C | A | B | 2 points increase | C |
| | 1-25 | | | | 0.030 | 1.0 | 0.121 | A | B | B | A | B | 2 points increase | B |
| | 1-26 | | | | 0.491 | 1.0 | 1.978 | A | A | B | A | B | 2 points increase | B |
| | 1-27 | | | | 0.489 | 0.8 | 1.981 | A | A | C | A | C | 2 points increase | C |
| | 1-28 | | | | 0.493 | 1.0 | 2.017 | A | A | B | A | C | 1 point increase | C |
| | 1-29 | | | | 0.189 | 1.0 | 0.775 | A | A | B | A | A | 2 points increase | B |
| | 1-30 | | | | 0.192 | 10 | 0.787 | A | A | A | A | A | 3 points increase | A |
| | 1-31 | | | | 0.185 | 12 | 0.762 | A | A | A | A | A | 2 points increase | A |
| Com. ex. 1 | 1-32 | | | Lathe | 0.025 | 30 | 0.092 | A | D | D | D | D | 2 points increase | D |
| | 1-33 | | | | 0.520 | 30 | 2.106 | E | A | A | A | C | 4 points increase | E |

Example 2

An aluminum cylinder (conductive substrate) was cut to have a diameter of 84 mm by the same method as in Example 1. A flat tool was used, tool feed was set to 0.03 mm/rotation, and a tool application angle was adjusted so that Ra after layer deposition (after each layer formation) was 0.120 μm±0.010 μm. The cylinder processed under the above-described conditions was placed in the plasma CVD apparatus illustrated in FIG. 2, and under the common condition indicated in Table 3, a lower injection preventing layer, a photoconductive layer, and a surface layer were successively formed. At this time, the conditions indicated by asterisks in Table 3 were set as in Table 4 to produce electrophotographic photosensitive members No. 2-1 to 2-9 having different compositions, densities, and hydrogen contents. These electrophotographic photosensitive members were evaluated as in Example 1. Further, gradation property evaluation and sensitivity evaluation described below were performed.

(Gradation Property Evaluation)

Gradation property evaluation was performed using a digital electrophotographic apparatus iRC-6800 produced by Canon Inc. with an optical system and an image data processing system modified into 1200 dpi, and using cyan toner. An area gradation dot screen was used at line density of 45 degrees 170 lpi (170 lines in 1 inch) by an image exposure light, and gradation data with the entire gradation range being equivalently divided into 17 stages by area gradation (that is, area gradation of a dot portion for image exposure) was prepared. At this time, each gradation was numbered with the darkest gradation being 17 and the lightest gradation being 0 to provide gradation stages.

Then, the produced electrophotographic photosensitive member was placed in the modified electrophotographic apparatus, and the image was output on an A3 sheet with the gradation data in a text mode. Occurrence of image deletion due to high humidity affects evaluation of an image blur. Thus, a photosensitive member heater was turned on in an environment of a temperature of 22° C. and relative humidity of 50%, and the surface of the electrophotographic photosensitive member was maintained at 40° C. and, then the image was output. For the obtained image, an image concentration was measured for each gradation by a reflection concentration meter (504 spectral concentration meter produced by X-Rite, Inc.). In the reflection concentration measurement, three images were output for each gradation, and an average value of image densities thereof was used as an evaluation value.

A correlation coefficient between the evaluation value thus obtained and the gradation stages was calculated, and a difference from a correlation coefficient of 1.00 at which gradation expression was obtained with a reflection concentration of each gradation being completely linearly changed was obtained. Then, the ratio of "a difference calculated from the correlation coefficient of the electrophotographic photosensitive member produced under each deposition condition" to "a difference calculated from the correlation coefficient of the electrophotographic photosensitive member produced under the deposition condition 2-4" was used as an index of gradation, and evaluation was performed. In the evaluation, a smaller value indicates higher gradation property and more linear gradation expression.

A . . . The ratio of the difference from the correlation coefficient of 1.00 calculated from the correlation coefficient of the electrophotographic photosensitive member produced under each deposition condition to the difference from the correlation coefficient of 1.00 calculated from the correlation coefficient of the electrophotographic photosensitive member produced under the deposition condition 2-4 is 1.60 or less.

B . . . The ratio of the difference from the correlation coefficient of 1.00 calculated from the correlation coefficient of the electrophotographic photosensitive member produced under each deposition condition to the difference from the correlation coefficient of 1.00 calculated from the correlation coefficient of the electrophotographic photosensitive member produced under the deposition condition 2-4 is more than 1.60 and not more than 1.70.

C . . . The ratio of the difference from the correlation coefficient of 1.00 calculated from the correlation coefficient of the electrophotographic photosensitive member produced under each deposition condition to the difference from the correlation coefficient of 1.00 calculated from the correlation coefficient of the electrophotographic photosensitive member produced under the deposition condition 2-4 is more than 1.70 and not more than 1.80.

D . . . The ratio of the difference from the correlation coefficient of 1.00 calculated from the correlation coefficient of the electrophotographic photosensitive member produced under each deposition condition to the difference from the correlation coefficient of 1.00 calculated from the correlation coefficient of the electrophotographic photosensitive member produced under the deposition condition 2-4 is more than 1.80 and not more than 1.90.

E . . . The ratio of the difference from the correlation coefficient of 1.00 calculated from the correlation coefficient of the electrophotographic photosensitive member produced under each deposition condition to the difference from the correlation coefficient of 1.00 calculated from the correlation coefficient of the electrophotographic photosensitive member produced under the deposition condition 2-4 is more than 1.90.

In this ranking, it was determined that the advantage of the present invention was obtained in C or more.

(Sensitivity Evaluation)

A modified digital electrophotographic apparatus iRC-6800 produced by Canon Inc. was used. With image exposure being cut off, a high pressure power supply was connected to each of a wire and a grid of a charger, a grid potential was set to 820 V, and a current supplied to the wire of the charger was adjusted to set a surface potential of the electrophotographic photosensitive member to 450 V at the position of a color developer. Next, while charging was performed under the previously set charging condition, the image exposure was applied, and the application energy was adjusted to set the potential of the position of the color developer to 100 V. The application energy at that time was defined as sensitivity. An image exposure light source of the electrophotographic apparatus used in sensitivity evaluation was a semiconductor laser having an oscillation wavelength of 658 nm. At that time, relative comparison was indicated with respect to light sensitivity of the 1.00 when the electrophotographic photosensitive member under the deposition condition 2-4 produced in the Example 2 was mounted.

A . . . The ratio of application energy to application energy of the electrophotographic photosensitive member under the deposition condition 2-4 produced in Example 2 was less than 1.05.

B . . . The ratio of application energy to application energy of the electrophotographic photosensitive member under the deposition condition 2-4 produced in Example 2 was 1.05 or more and less than 1.10.

C . . . The ratio of application energy to application energy of the electrophotographic photosensitive member under the deposition condition 2-4 produced in Example 2 was 1.10 or more and less than 1.15.

D . . . The ratio of application energy to application energy of the electrophotographic photosensitive member under the deposition condition 2-4 produced in Example 2 was 1.15 or more and less than 1.20.

E . . . The ratio of application energy to application energy of the electrophotographic photosensitive member under the deposition condition 2-4 produced in Example 2 was 1.20 or more.

In this ranking, it was determined that the advantage of the present invention was obtained in C or more. The obtained result is indicated in Table 7.

Comparative Example 2

The conductive substrate was processed as in Example 2, and an electrophotographic photosensitive member was produced under a production condition indicated in Table 3. At this time, electrophotographic photosensitive members No. 2-10 to 2-12 were produced under the conditions indicated in Table 5 that indicate parts with asterisks in Table 3. The electrophotographic photosensitive member No. 2-13 was produced under the condition indicated in Table 6. The electrophotographic photosensitive members were evaluated as in Example 1, and the obtained result was indicated in Table 7 together with the result of Example 2.

As indicated in Table 7, when a surface layer having the composition and density in the ranges of the present invention was used, satisfactory gradation property and sensitivity were obtained, torque was not increased by enduring, and a satisfactory result was obtained. A satisfactory result was also obtained for a passage test. When the electrophotographic photosensitive members 2-4 and 2-8 were compared, the electrophotographic photosensitive member 2-4 had higher sensitivity although the electrophotographic photosensitive members 2-4 and 2-8 had substantially the same C/(Si+C). Thus, it was found that H/(Si+C+H) could be 0.30 or more, although not limited in the present invention. When the electrophotographic photosensitive members 2-4 and 2-9 were compared, it was found that the electrophotographic photosensitive member 2-4 had increased cleaning latitude after the endurance test although the electrophotographic photosensitive members 2-4 and 2-9 had substantially the same C/(Si+C). Thus, it was found that H/(Si+C+H) could be 0.45 or less, although not limited in the present invention.

Meanwhile, for the electrophotographic photosensitive members 2-10 and 2-13 produced in Comparative example 2, the improved surface shape reduced the torque in the initial stage and prevented passage, but after the endurance test for 500 thousand sheets, torque was significantly increased as compared to that of the electrophotographic photosensitive member 1-32 in Comparative example 1. If the torque is continuously increased, a cleaning failure or a banding phenomenon may occur, and in view of demands in the POD market, it is desirable that the torque is not increased. A reflectivity central value of a reflection spectral waveform was reduced by 8 to 9 points, and the reflectivity central value was reduced to half or less. This means that a material such as a reflection preventing layer is formed on the surface. Although not determined by an analysis, there is a possibility that a top surface itself of the surface layer was changed, or the top surface was changed to change the sticking probability and then some substance was applied by a long-term endurance test. It is expected that the changed surface layer or the applied layer has a function of preventing reflection if having a refractive index between a refractive index of the surface layer itself and a refractive index of air. This suggests the possibility that some layer having the refractive index between the refractive index of the surface layer itself and the refractive index of air is formed to increase torque.

For the electrophotographic photosensitive member 2-11, relatively low gradation property was obtained in the initial stage. It was found that a higher level was required from the demand of the POD market or the graphic art market supposed in the present invention. In the electrophotographic photosensitive member 2-12, sensitivity was reduced. This sensitivity has no problem in normal use. However, in a product level for the POD market described above, there was a risk that the life of an optical system such as a laser could not satisfy the demand, or stability of an element was affected. Thus, it was found that sensitivity needed to be further improved.

From the result above, it was found that the surface shape was controlled, and then the composition and atom density of the surface layer satisfied the values of the present invention, and thus a high quality electrophotographic photosensitive member that could satisfy strict demands of the POD market or the graphic art market was obtained.

TABLE 3

| Gas type/condition | Lower injection preventing layer | Photoconductive layer | Surface layer |
|---|---|---|---|
| $SiH_4$ [ml/min(normal)] | 350 | 450 | * |
| $H_2$ [ml/min(normal)] | 750 | 2200 | |
| $CH_4$ [ml/min(normal)] | | | * |
| $B_2H_6$ [ppm (to $SiH_4$)] | 1500 | 1 | |
| NO[ml/min(normal)] | 10 | | |
| Substrate temperature [° C.] | 260 | 260 | 290 |
| Pressure [Pa] | 40 | 80 | 80 |
| RF power [W] | 400 | 800 | * |
| Layer thickness [μm] | 3 | 25 | 0.5 |

TABLE 4

| | 2-1 | 2-2 | 2-3 | 2-4 | 2-5 | 2-6 | 2-7 | 2-8 | 2-9 |
|---|---|---|---|---|---|---|---|---|---|
| $SiH_4$ [ml/min (normal)] | 26 | 26 | 26 | 26 | 35 | 26 | 26 | 26 | 26 |
| $CH_4$ [ml/min (normal)] | 500 | 450 | 400 | 360 | 190 | 150 | 190 | 260 | 400 |
| RF power [W] | 800 | 750 | 750 | 700 | 750 | 700 | 700 | 850 | 650 |

TABLE 5

| | 2-10 | 2-11 | 2-12 |
|---|---|---|---|
| $SiH_4$ [ml/min(normal)] | 26 | 35 | 26 |
| $CH_4$ [ml/min(normal)] | 500 | 190 | 450 |
| RF power [W] | 750 | 700 | 950 |

TABLE 6

| Gas type/condition | Lower injection preventing layer | Photoconductive layer | Surface layer |
|---|---|---|---|
| $SiH_4$ [ml/min(normal)] | 350 | 450 | 26 |
| $H_2$ [ml/min(normal)] | 750 | 2200 | |
| $CH_4$ [ml/min(normal)] | | | 1400 |
| $B_2H_6$ [ppm (to $SiH_4$)] | 1500 | 1 | |
| NO [ml/min(normal)] | 10 | | |
| Substrate temperature [° C.] | 260 | 260 | 260 |
| Pressure [Pa] | 40 | 80 | 55 |
| RF power [W] | 400 | 800 | 400 |
| Layer thickness [μm] | 3 | 25 | 0.5 |

TABLE 7

| | Deposition condition No. | C/(Si + C) | Si + C atom density ($10^{22}$ atom/cm$^2$) | H/(Si + C + H) | Surface roughness | Presence or absence of moire | Initial torque | Initial passage | Torque after enduring | Latitude | Reflectivity central value | Gradation property | Sensitivity | General determination |
|---|---|---|---|---|---|---|---|---|---|---|---|---|---|---|
| Ex. 2 | 2-1 | 0.75 | 6.60 | 0.43 | Ra = 0.120 μm ± 0.01 | A | A | A | A | B | 1 point decrease | A | C | C |
| | 2-2 | 0.73 | 6.69 | 0.44 | Rsm = 30.0 μm ± 2.0 | | | | A | A | 2 points increase | A | B | B |
| | 2-3 | 0.73 | 6.81 | 0.41 | Rzjis = 0.700 μm ± 0.2 | | | | A | A | 2 points increase | A | B | B |
| | 2-4 | 0.72 | 6.90 | 0.41 | | | | | A | A | 2 points increase | A | B | B |
| | 2-5 | 0.61 | 7.67 | 0.31 | | | | | A | A | 2 points increase | A | A | A |
| | 2-6 | 0.63 | 7.84 | 0.30 | | | | | A | A | 3 points increase | A | A | A |
| | 2-7 | 0.65 | 7.67 | 0.31 | | | | | A | A | 2 points increase | A | A | A |
| | 2-8 | 0.71 | 7.56 | 0.29 | | | | | A | A | 2 points increase | A | C | C |
| | 2-9 | 0.72 | 6.63 | 0.46 | | | | | A | C | 3 points decrease | A | B | C |
| Com. | 2-10 | 0.74 | 6.48 | 0.45 | | | | | E | E | 8 points decrease | A | C | E |
| ex. 2 | 2-11 | 0.59 | 7.61 | 0.32 | | | | | A | A | 1 point increase | D | A | D |

TABLE 7-continued

| Deposition condition No. | C/(Si + C) | Si + C atom density ($10^{22}$ atom/cm$^2$) | H/(Si + C + H) | Surface roughness | Presence or absence of moire | Initial torque | Initial passage | Torque after enduring | Latitude | Reflectivity central value | Gradation property | Sensitivity | General determination |
|---|---|---|---|---|---|---|---|---|---|---|---|---|---|
| 2-12 | 0.76 | 7.23 | 0.34 | | | | | A | A | 1 point increase | A | E | E |
| 2-13 | 0.70 | 6.35 | 0.39 | | | | | E | E | 9 points decrease | A | A | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-270833, filed Nov. 27, 2009, and Japanese Patent Application No. 2010-256021, filed Nov. 16, 2010, which are hereby incorporated by reference herein in their entirety.

What is claimed is:

1. An electrophotographic photosensitive member, comprising:

a conductive substrate;

a photoconductive layer on the conductive substrate; and a surface layer made of hydrogenated amorphous silicon carbide on the photoconductive layer, wherein the ratio (C/(Si+C)) of the number of carbon atoms (C) to the sum of the number of silicon atoms (Si) and the number of carbon atoms (C) in the surface layer is 0.61 to 0.75, both inclusive, the sum of the density of silicon atoms and the density of carbon atoms in the surface layer is $6.60\times10^{22}$ atoms/cm$^3$ or more, an arithmetic average roughness Ra of the surface layer defined by JIS B0601:2001 is 0.029 μm to 0.500 μm, both inclusive, a ten point average roughness Rzjis of the surface layer defined by JIS B0601:2001 is 0.100 μm to 2.000 μm, both inclusive, and an average length Rsm of a roughness curve element of the surface layer defined by JIS B0601:2001 is 1.0 μm to 150.0 μm, both inclusive.

2. The electrophotographic photosensitive member according to claim 1, wherein the arithmetic average roughness Ra of the surface layer defined by JIS B0601:2001 is 0.050 μm to 0.200 μm, both inclusive.

3. The electrophotographic photosensitive member according to claim 1, wherein the ten point average roughness Rzjis of the conductive substrate defined by JIS B0601:2001 is 0.100 μm to 2.000 μm, both inclusive, and the average length Rsm of a roughness curve element of the conductive substrate defined by JIS B0601:2001 is 1.0 μm to 150.0 μm, both inclusive.

4. The electrophotographic photosensitive member according to claim 3, wherein the average length Rsm of the roughness curve element of the conductive substrate defined by JIS B0601:2001 is 1.0 μm to 10.0 μm, both inclusive, and a surface shape of the conductive substrate is formed by imprinting of pressing a mold.

5. The electrophotographic photosensitive member according to claim 3, wherein the average length Rsm of the roughness curve element of the conductive substrate defined by JIS B0601:2001 is 10.0 μm to 30.0 μm, both inclusive, and a surface shape of the conductive substrate is formed by tool cutting with a lathe.

6. The electrophotographic photosensitive member according to of claim 1, wherein the ratio (H/(Si+C+H)) of the number of hydrogen atoms (H) to the sum of the number of silicon atoms (Si), the number of carbon atoms (C) and the number of hydrogen atoms (H) in the surface layer is 0.30 to 0.45 both inclusive.

7. An electrophotographic apparatus comprising the electrophotographic photosensitive member according to claim 1.

8. An electrophotographic photosensitive member comprising:

a conductive substrate;

a photoconductive layer on the conductive substrate; and a surface layer made of hydrogenated amorphous silicon carbide on the photoconductive layer, wherein the ratio (C/(Si+C)) of the number of carbon atoms (C) to the sum of the number of silicon atoms (Si) and the number of carbon atoms (C) in the surface layer is 0.61 to 0.75, both inclusive, the sum of the density of silicon atoms and the density of carbon atoms in the surface layer is $6.60\times10^{22}$ atoms/cm$^3$ or more, and arithmetic average roughness Ra of the surface layer defined by JIS B0601:2001 is 0.029 μm to 0.500 μm, both inclusive, wherein a ten point average roughness Rzjis of the conductive substrate defined by JIS B0601:2001 is 0.100 μm to 2.000 μm, both inclusive, and an average length Rsm of a roughness curve element of the conductive substrate defined by JIS B0601:2001 is 1.0 μm to 10.0 μm, both inclusive, and a surface shape of the conductive substrate is formed by imprinting of pressing a mold.

9. The electrophotographic photosensitive member according to claim 8, wherein the arithmetic average roughness Ra of the surface layer defined by JIS B0601:2001 is 0.050 μm to 0.200 μm, both inclusive.

10. The electrophotographic photosensitive member according to of claim 8, wherein the ratio (H/(Si+C+H)) of the number of hydrogen atoms (H) to the sum of the number of silicon atoms (Si), the number of carbon atoms (C) and the number of hydrogen atoms (H) in the surface layer is 0.30 to 0.45 both inclusive.

11. An electrophotographic apparatus comprising the electrophotographic photosensitive member according to claim 8.

* * * * *